US011603730B2

(12) United States Patent
Weaver et al.

(10) Patent No.: US 11,603,730 B2
(45) Date of Patent: Mar. 14, 2023

(54) BLOWOUT PREVENTER TESTING APPARATUS AND METHOD

(71) Applicant: National Oilwell Varco, L.P., Houston, TX (US)

(72) Inventors: Randall Ferrain Weaver, McAlester, OK (US); Clifton Dee Eggleston, McAlester, OK (US)

(73) Assignee: National Oilwell Varco, L.P., Houston, TX (US)

( * ) Notice: Subject to any disclaimer, the term of this patent is extended or adjusted under 35 U.S.C. 154(b) by 1 day.

(21) Appl. No.: 17/264,211

(22) PCT Filed: Jul. 31, 2019

(86) PCT No.: PCT/US2019/044268

§ 371 (c)(1),
(2) Date: Jan. 28, 2021

(87) PCT Pub. No.: WO2020/028455

PCT Pub. Date: Feb. 6, 2020

(65) Prior Publication Data

US 2021/0301619 A1 Sep. 30, 2021

Related U.S. Application Data

(60) Provisional application No. 62/712,689, filed on Jul. 31, 2018.

(51) Int. Cl.
*E21B 33/06* (2006.01)

(52) U.S. Cl.
CPC ..... *E21B 33/062* (2013.01)

(58) Field of Classification Search
CPC ..... E21B 33/062
See application file for complete search history.

(56) References Cited

U.S. PATENT DOCUMENTS 1,228,686 A 6/1917 Maxwell
1,854,058 A * 4/1932 Otis ..... E21B 33/062 92/61
1,938,019 A * 12/1933 Hild ..... E21B 33/06 166/88.4
2,064,267 A * 12/1936 Nixon ..... E21B 33/062 251/272
2,113,529 A 4/1938 Hild
2,318,882 A * 5/1943 Nevill ..... E21B 33/062 277/325

(Continued)

FOREIGN PATENT DOCUMENTS

NO 155508 B * 12/1986

OTHER PUBLICATIONS

NO155508B,Translation, 1986 (Year: 1986).*
International Search Report and Written Opinion dated Dec. 4, 2019, for Application No. PCT/US2019/044268.

*Primary Examiner* — Daphne M Barry
(74) *Attorney, Agent, or Firm* — Conley Rose, P.C.

(57) ABSTRACT

A blowout preventer including a housing including a central passage and a first aperture, and a first ram assembly slidably disposed in the first aperture, wherein the first ram assembly includes a ram block and an actuator configured to rotate the ram block when the ram block is disposed in the first aperture of the housing.

20 Claims, 7 Drawing Sheets

(56) References Cited

U.S. PATENT DOCUMENTS

| | | | | | |
|---|---|---|---|---|---|
| 3,791,616 | A * | 2/1974 | Le Rouax | E21B 33/062 | 251/1.3 |
| 4,076,208 | A | 2/1978 | Olson | | |
| 4,558,842 | A * | 12/1985 | Peil | E21B 33/062 | 285/305 |
| 4,582,293 | A | 4/1986 | Jones | | |
| 4,638,972 | A * | 1/1987 | Jones | E21B 33/062 | 251/1.3 |
| 4,938,290 | A * | 7/1990 | Leggett | E21B 33/062 | 166/387 |
| 4,943,031 | A * | 7/1990 | Van Winkle | E21B 33/062 | 251/1.3 |
| 4,964,610 | A * | 10/1990 | Wong | E21B 33/062 | 251/1.3 |
| 5,765,813 | A | 6/1998 | Lam et al. | | |
| 8,740,174 | B2 | 6/2014 | Juda et al. | | |
| 9,004,089 | B2 * | 4/2015 | Foote | E21B 33/062 | 251/1.3 |
| 10,167,695 | B2 * | 1/2019 | Kroesen | E21B 33/061 | |
| 2005/0211428 | A1 * | 9/2005 | Wright | E21B 33/062 | 166/54.1 |
| 2006/0102359 | A1 | 5/2006 | Brown et al. | | |
| 2013/0081823 | A1 | 4/2013 | Wood | | |
| 2013/0126763 | A1 | 5/2013 | Guo et al. | | |
| 2014/0284506 | A1 | 9/2014 | Arteaga et al. | | |

* cited by examiner

BLOWOUT PREVENTER TESTING APPARATUS AND METHOD

CROSS-REFERENCE TO RELATED APPLICATIONS

The present application is a 35 U.S.C. § 371 national stage application of PCT/US2019/044268 filed Jul. 31, 2019, and entitled "Blowout Preventer Testing Apparatus and Method" which claims benefit of U.S. provisional patent application No. 62/712,689 filed Jul. 31, 2018, entitled "Blowout Preventer Testing Apparatus and Method" both of which are incorporated herein by reference in their entirety for all purposes.

STATEMENT REGARDING FEDERALLY SPONSORED RESEARCH OR DEVELOPMENT

Not applicable.

BACKGROUND

Hydrocarbon production systems utilize a downhole pump disposed in a wellbore for pumping fluids from a subterranean earthen formation through production tubing extending from the downhole pump to a surface of the wellbore. In some applications, a blowout preventer (BOP) is installed at a wellhead disposed at a surface of the wellbore, where the BOP is configured to control the inlet and outlet of fluid from the wellbore, and particularly, to confine well fluid in the wellbore in response to a "kick" or rapid influx of formation fluid into the wellbore. The BOP may include both ram BOPs and annular BOPs. Ram BOPs include one or more rams that extend towards the center of the wellbore upon actuation to restrict flow through the ram BOP. In some applications, the inner sealing surface of each ram of the ram BOP is fitted with an elastomeric packer for sealing the wellbore. The ram BOP may include multiple sets of rams (e.g., a set of upper rams and a set of lower rams, etc.). In certain applications, the ram BOP may be periodically pressure tested to ensure the proper functioning of the components of the ram BOP. For example, each set of rams of the ram BOP may be pressure tested before being installed at the wellhead. In at least some applications, at least some of the rams of the ram BOP may need to be removed and reconfigured before being reinstalled in the ram BOP to permit the pressure testing of each of the set of rams of the ram BOP.

BRIEF SUMMARY OF THE DISCLOSURE

An embodiment of a blowout preventer comprises a housing comprising a central passage and a first aperture, and a first ram assembly slidably disposed in the first aperture, wherein the first ram assembly comprises a ram block and an actuator configured to rotate the ram block when the ram block is disposed in the first aperture of the housing. In some embodiments, the ram block of the first ram assembly comprises a port extending between a first endface and a second endface of the ram block. In some embodiments, the blowout preventer further comprises a plurality of circumferentially spaced pins extending between the actuator and the ram block of the first ram assembly. In certain embodiments, the ram block of the first ram assembly includes a port extending between a first endface and a second endface of the ram block. In certain embodiments, the first ram assembly further comprises a locking sleeve disposed about the actuator, wherein the locking sleeve comprises a locked position restricting relative rotation between the ram block and the housing and an unlocked position permitting relative rotation between the ram block and the housing. In some embodiments, the first ram assembly further comprises a locking pin coupled to the locking sleeve and the actuator, wherein the locking pin is configured to lock the locking sleeve in the locked position. In some embodiments, the blowout preventer further comprises a second ram assembly slidably disposed in a second aperture formed in the housing that is axially spaced from the first aperture, wherein the second ram assembly comprises a ram block and an actuator configured to rotate the ram block of the second ram assembly when the ram block is disposed in the second aperture of the housing. In certain embodiments, the ram block of the second ram assembly includes a port extending between a first endface and a second endface of the ram block.

An embodiment of a ram assembly for a blowout preventer comprises a housing configured to couple with a housing of the blowout preventer, a ram block coupled to a stem, and an actuator disposed about the stem, and wherein the actuator is configured to rotate the ram block in response to the application of a torque to an outer surface of the actuator. In some embodiments, the actuator comprises an inner surface comprising a plurality of circumferentially spaced planar surfaces. In some embodiments, the actuator comprises a threaded inner surface configured to matingly engage a threaded outer surface of the stem. In certain embodiments, the ram assembly further comprises a plurality of circumferentially spaced pins extending between the actuator and the ram block that rotationally lock the actuator with the ram block. In certain embodiments, the ram assembly further comprises a locking sleeve disposed about the actuator, wherein the locking sleeve comprises a locked position restricting relative rotation between the ram block and a housing of the ram assembly and an unlocked position permitting relative rotation between the ram block and the housing. In some embodiments, the ram assembly further comprises a locking pin coupled to the locking sleeve and the actuator, wherein the locking pin is configured to lock the locking sleeve in the locked position. In some embodiments, the ram assembly further comprises a locking tab extending from an outer surface of the locking sleeve, wherein the locking tab is configured to restrict relative rotation between the actuator and the housing when the locking sleeve is in the locked position. In certain embodiments, the ram assembly further comprises a retainer coupled to an end of the actuator, wherein the locking sleeve is disposed adjacent the retainer when the locking sleeve is in the unlocked position.

An embodiment of a method for operating a blowout preventer comprises (a) disposing a first ram assembly in a first aperture formed in a housing of the blowout preventer, and (b) rotating a ram block of the first ram assembly between a first angular position and a second angular position with the first ram assembly disposed in the first aperture of the housing. In some embodiments, (b) comprises applying a torque to an actuator that is rotatably locked to the ram block. In some embodiments, the method further comprises (c) displacing a locking sleeve from a locked position to an unlocked position to permit relative rotation between the actuator and a housing of the first ram assembly. In certain embodiments, the method further comprises (d) removing a locking pin from the locking sleeve to permit the locking sleeve to enter the unlocked position.

BRIEF DESCRIPTION OF THE DRAWINGS

For a detailed description of exemplary embodiments, reference will now be made to the accompanying drawings in which.

DETAILED DESCRIPTION

Figure 1:
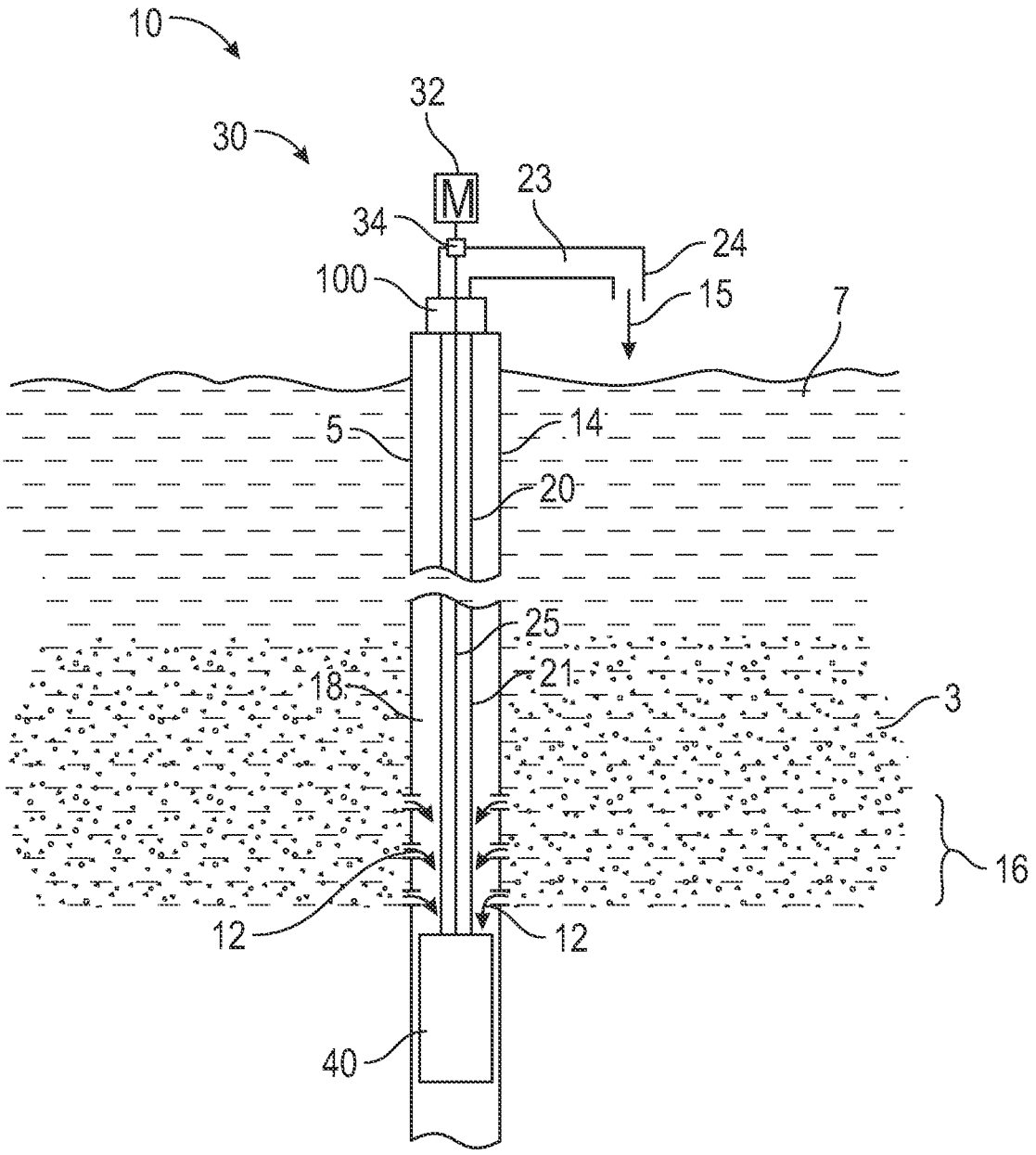
FIG. 1 is a schematic view of an embodiment of a well system in accordance with principles disclosed herein.
Figure 2:
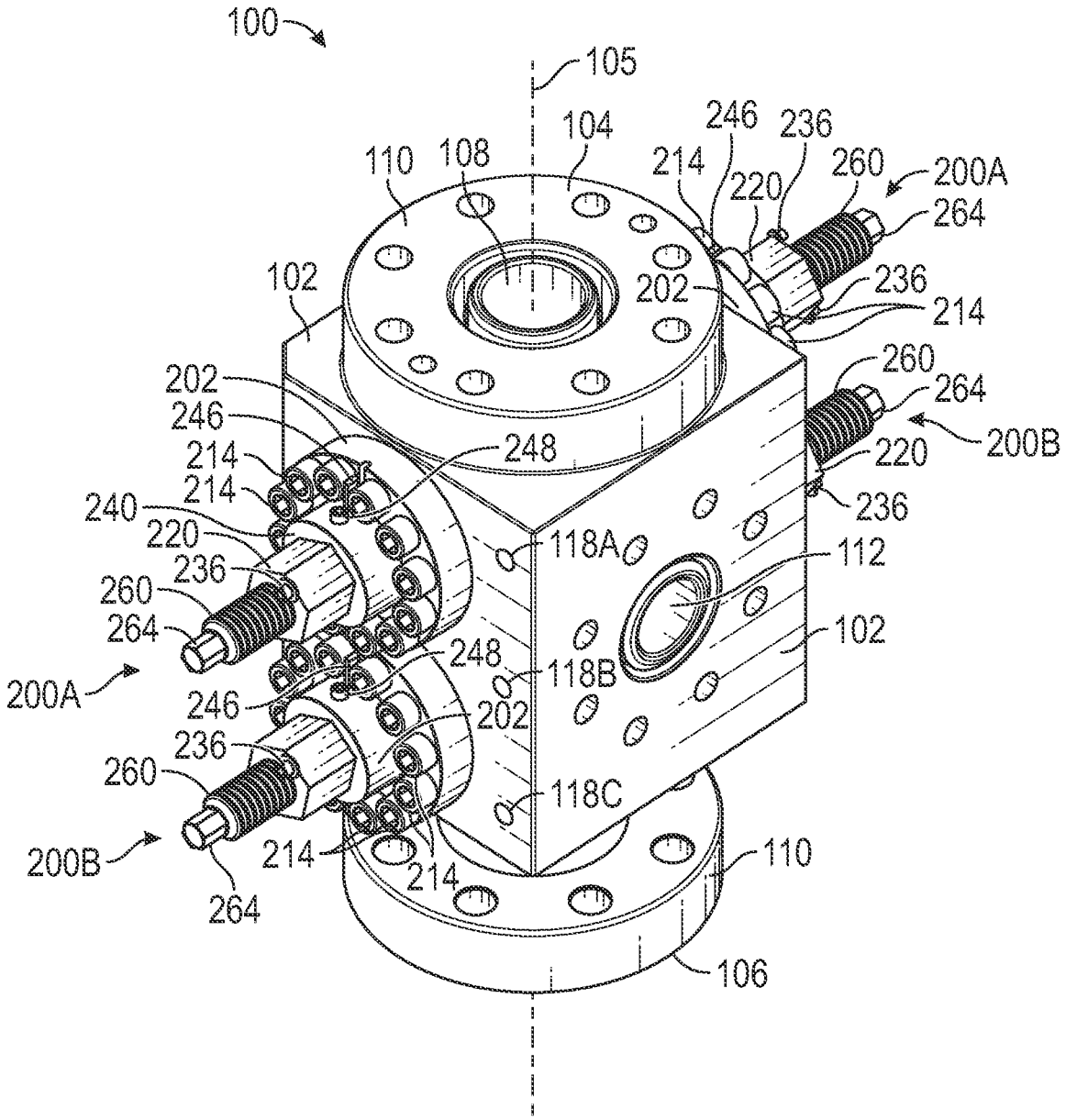
FIG. 2 is a perspective view of an embodiment of a ram BOP of the well system of FIG. 1 in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, a well or production system 10 is shown. Production system 10 is generally configured for extracting hydrocarbon bearing reservoir fluid (indicated by arrow 12 in FIG. 1) from a subsurface reservoir 3 via a wellbore 5 that extends through the subsurface reservoir 3 from the surface 7. Though shown as vertical in FIG. 1, in general, wellbore 5 may have generally vertical portions or generally horizontal portions and may have curved portions between various portions. In the embodiment of FIG. 1, production system 10 includes a tubular casing 14, which may be a metal pipe for example, is positioned and cemented in wellbore 5. Casing 14 has a set of perforations 16 at a location corresponding to subsurface reservoir 3 to provide for fluid communication between subsurface reservoir 3 and a central passage 18 of casing 14.

In this embodiment, production system 10 additionally includes production tubing 20 that extends into casing 14 from the surface 7, an extension shaft 25 that extends into and through production tubing 20 from a set of exterior surface equipment 30 positioned at the surface 7, and a positive displacement device or pump 40. Pump 40 is coupled to the lower ends of production tubing 20 and is positioned within casing 14 and wellbore 5 at a selected depth below the surface 7. Production tubing 20 includes a lower end 21 within casing 14 and wellbore 5, and an upper end 23 opposite lower end 21 that may extend above the surface 7, where upper end 23 terminates at a discharge port 24. The discharge port 24 of production tubing 20 is routed to a convenient location to release an outlet stream 15 of fluid produced from subsurface reservoir 3.

Surface equipment 30 of production system 10 includes a source of rotational or reciprocating power, which is motor 32 in this embodiment, a shaft bearing 34, and other equipment known in the art. Shaft 25 may also be called a rod string and is coupled between pump 40 and motor 32 to transmit rotational or reciprocating power from motor 32 to pump 40. In this embodiment, motor 32 is positioned outside the production tubing 20 and outside the wellbore 5, and the fluid-tight shaft bearing 34 allows shaft 25 to extend into production tubing 20 without a loss of reservoir fluid 12. During operation of production system 10, fluid 12 from subsurface reservoir 3 enters casing 14 through perforations 16, where the reservoir fluid 12 enters pump 40 suspended within casing 14. Pump 40 discharges the reservoir fluid 12 into the lower end 21 of production tubing 20, though which the reservoir fluid 12 flows to the surface 7 and is discharged from the upper end 23 of production tubing 20 at discharge port 24 as outlet stream 15.

Surface equipment 30 of production system 10 additionally includes a ram blowout preventer (BOP) 100 coupled to a wellhead affixed to an upper end of casing 14. In this embodiment, ram BOP 100 comprises an internal ram BOP 100 configured to selectably seal against an outer surface of extension rod 25 to thereby isolate the lower end 21 of production tubing 20 from the upper end 23. Thus, in the event of an uncontrolled influx of reservoir fluid 12 into wellbore 5, an operator of production system 10 may actuate ram BOP 100 to seal wellbore 5 (including the lower end 21 of production tubing 20 from the surrounding environment. Although in this embodiment ram BOP 100 comprises an internal ram BOP 100 of a production system 10, in other embodiments, ram BOP 100 may comprise a ram BOP 100 for use in a drilling system for sealing either a drill string or an annulus formed in a wellbore.

Referring to FIGS. 2-7, an embodiment of the ram BOP 100 of drilling system 10 is shown. While ram BOP 100 is shown as part of drilling system 10, ram BOP 100 may be utilized in other well systems, including land-based well systems. In the embodiment of FIGS. 2-7, annular BOP 100 has a central or longitudinal axis 105 and generally includes a housing or body 102, a first or lower set of ram assemblies 200B, and a second or upper set of ram assemblies 200A that are axially spaced from the lower set of ram assemblies 200B. Although in this embodiment ram BOP 100 includes two sets of ram assemblies 200B, 200A, in other embodiments, the number of sets of axially spaced ram assemblies 200B, 200A may vary.

In this embodiment, the housing 102 of ram BOP 100 includes a first or upper end 104, a second or lower end 106 opposite upper end 104, and central bore or passage 108 extending between ends 104, 106. Housing 102 includes flange connectors 110 at each end 104, 106 for connecting ram BOP 100 with other components of production system 10. In this embodiment, housing 102 includes one or more radial ports 112 in fluid communication with central passage 108. Port 112 may be attached to a choke or kill line for communicating fluid to and from the central passage 108 of housing 102. Additionally, housing 102 includes a pair of first or lower ram passages 114 (shown in FIGS. 6, 7) which receive at least a portion of lower ram assemblies 200B, and a pair of second or upper ram passages 116 (shown in FIGS. 6, 7) which receive at least a portion of upper ram assemblies 200A. In this embodiment, housing 102 further includes a plurality of axially spaced test ports 118A-118C, each of which are in fluid communication with central passage 108.

Figure 3:
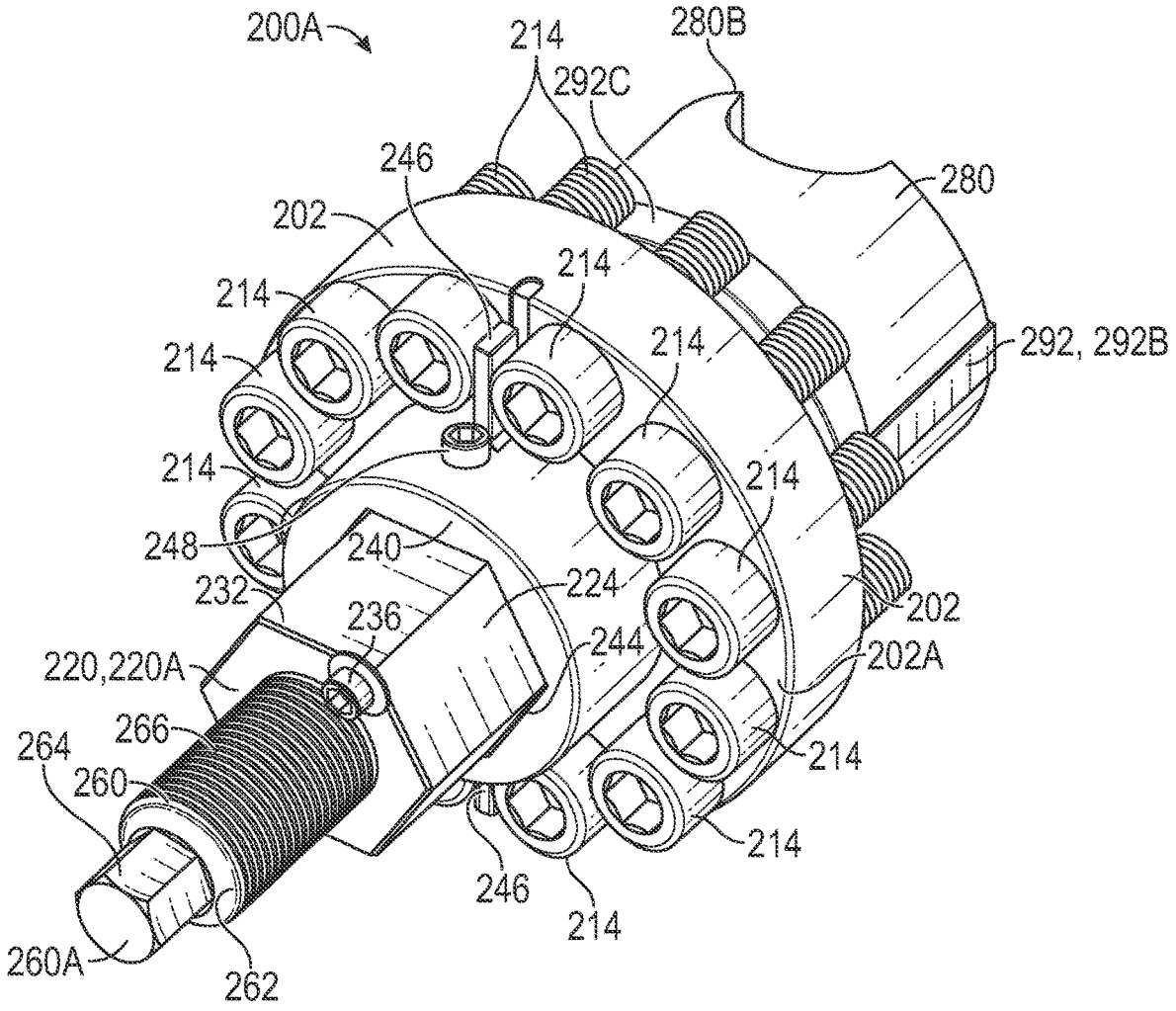
FIG. 3 is a perspective view of a ram assembly of the ram BOP of FIG. 2 in accordance with principles disclosed herein.
Figure 4:
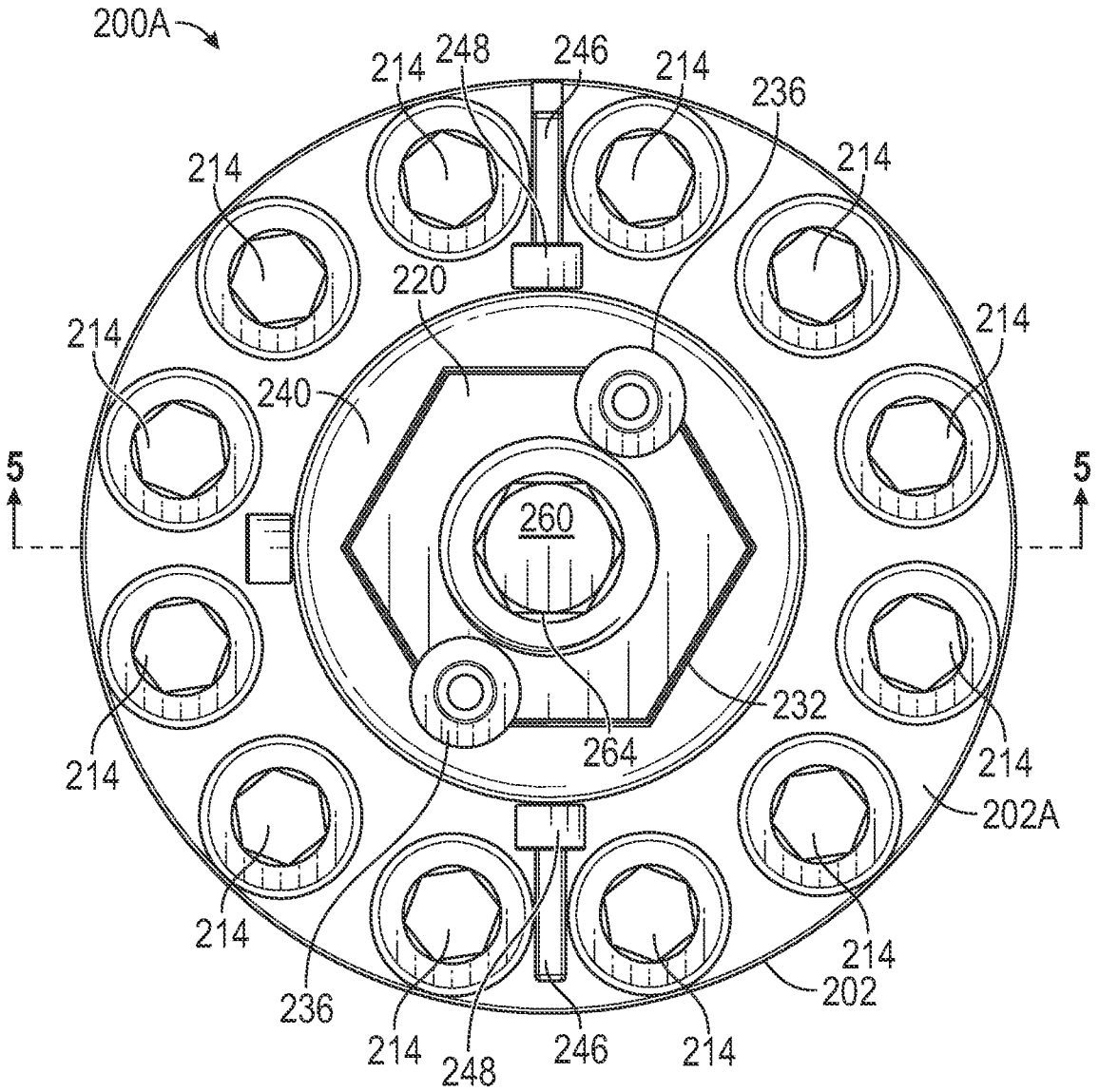
FIG. 4 is a front view of the ram assembly of FIG. 3.
Figure 5:
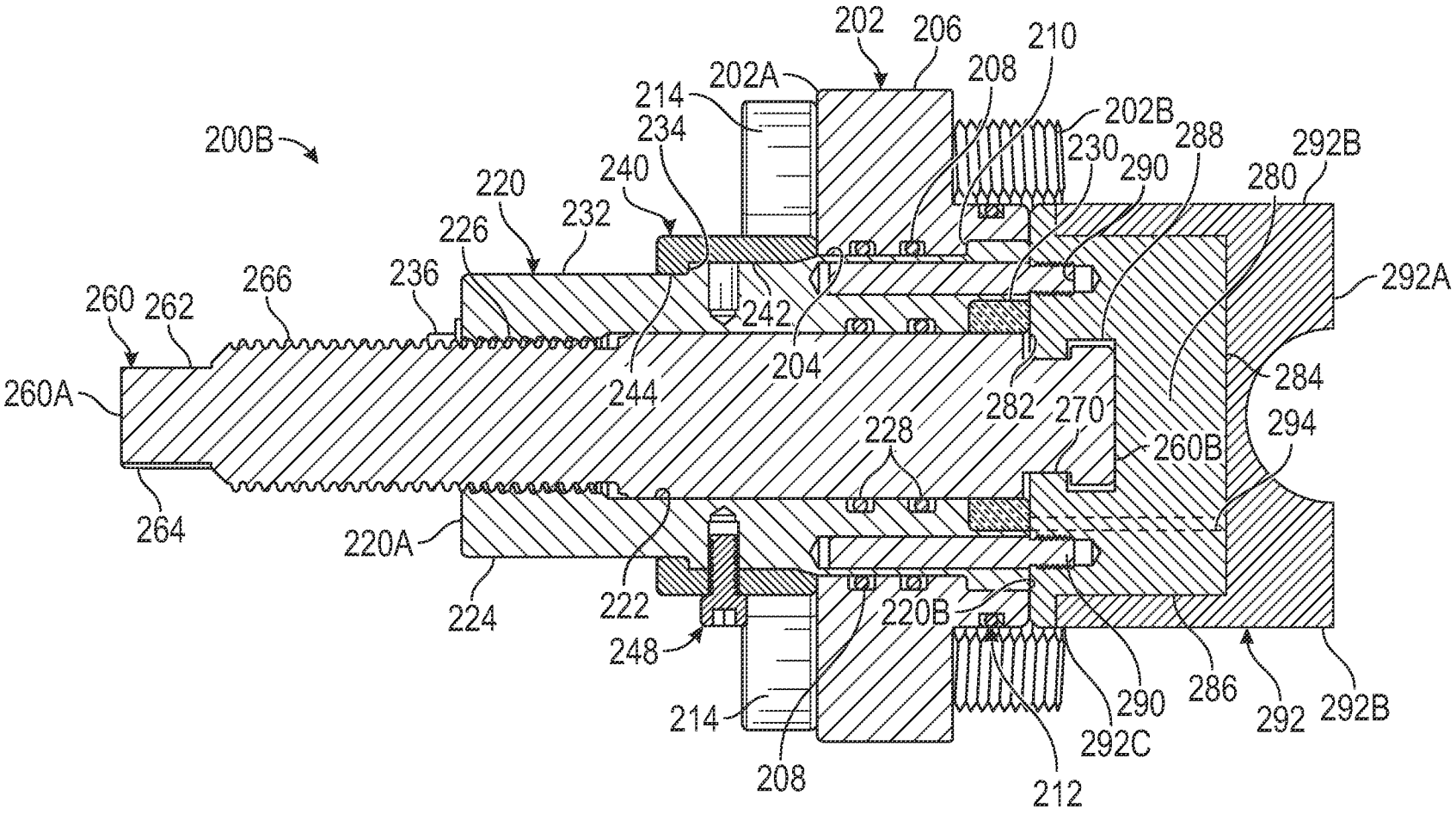
FIG. 5 is a cross-sectional view along lines 5-5 of FIG. 4 of the ram assembly of FIG. 3.

FIGS. 3-5 illustrate one of the lower ram assemblies 200B of ram BOP 100. However, lower ram assemblies 200B are configured similarly as upper ram assemblies 200A, and thus, the description of lower ram assembly 200A provided below is equally applicable to upper ram assemblies 200A. In this embodiment, lower ram assembly 200B generally includes a generally cylindrical housing 202, a cylindrical actuator 220, a locking sleeve 240, an elongate stem 260, and a ram block 280. Housing 202 of ram block assembly 200B includes a first or outer end 202A, a second or inner end 202B opposite outer end 202A, a central bore or passage defined by a generally cylindrical inner surface 204 extending between ends 202A, 202B, and a generally cylindrical outer surface 206 extending between ends 202A, 202B. In this embodiment, the inner surface 204 of housing 202 includes a pair of seal assemblies 208, each seal assembly 208 comprising a seal groove and a pair of annular seals disposed therein. Additionally, inner surface 204 includes an annular shoulder 210. In this embodiment, the outer surface 206 of housing 202 includes an annular seal assembly 212 comprising a seal groove and a pair of annular seals disposed therein. Seal assembly 212 is configured to sealingly engage the inner surface of the lower ram passage 114 of housing 102 in which lower ram assembly 200B is received. A plurality of circumferentially spaced releasable or threaded fasteners 214 extend through housing 202, threaded fasteners 214 configured to releasably couple ram assembly 200B with the housing 102 of ram BOP 100.

Actuator 220 of ram block assembly 200B includes a first or outer end 220A, a second or inner end 220B opposite outer end 220A, a central bore or passage defined by a generally cylindrical inner surface 222 extending between ends 220A, 220B, and a generally cylindrical outer surface 224 extending between ends 220A, 220B. In this embodiment, the inner surface 222 of actuator 220 includes a threaded portion or connector 226 extending from outer end 220A, and a pair of seal assemblies 228 spaced from threaded connector 226, each seal assembly 228 comprising a seal groove and a pair of annular seals disposed therein. Additionally, the inner surface 222 of actuator 220 includes an annular guide bushing 230 positioned at inner end 220B that acts as a bearing for assisting with relative rotation between stem 260 and actuator 220. In this embodiment, the outer surface 224 of actuator 220 includes a plurality of circumferentially spaced planar surfaces forming a hexagonal surface or portion 232 extending from outer end 220A and an annular shoulder 234. Additionally, in this embodiment, at least one retainer 236 extends into the outer end 220A of actuator 220, where retainer 236 extends radially outwards from outer surface 224 to prevent locking sleeve 240 from becoming completely disengaged from actuator 220.

The locking sleeve 240 of lower ram assembly 200B is generally cylindrical and includes a central bore or passage defined by an inner surface 242 extending between opposite axial ends of locking sleeve 240, and a generally cylindrical outer surface extending between the opposite axial ends of locking sleeve 240. In this embodiment, the inner surface 242 of locking sleeve 240 includes a hexagonal portion or surface 244 configured to matingly engage the hexagonal surface 232 of actuator 220. Additionally, the outer surface of locking sleeve 240 includes a plurality of circumferentially spaced locking tabs 246 positioned proximal an inner end of locking sleeve 240, where each locking tab extends radially outwards from the outer surface of locking sleeve 240.

In this embodiment, locking sleeve 240 includes a first or locked position (shown in FIGS. 3-5) where hexagonal surface 244 matingly engages the hexagonal surface 232 of actuator 220 to restrict relative rotation between locking sleeve 240 and actuator 220. Additionally, when locking sleeve 240 is disposed in the locked position, locking tabs 246 are each positioned between adjacent fasteners 214, thereby restricting relative rotation between locking sleeve 240 and housing 202 and locking the angular position of locking sleeve 240 and actuator 220. When locking sleeve 240 is disposed in the locked position, a plurality of circumferentially spaced locking pins 248 may be inserted radially through locking sleeve 240 and into the outer surface 232 of actuator 220 to lock the locking sleeve 240 in the locked position. Locking sleeve 240 also includes a second or unlocked position spaced from the locked position where an outer end of locking sleeve 240 is disposed adjacent retainer 236 and hexagonal surface 244 is disengaged from the hexagonal surface 232 of actuator 220, thereby permitting relative rotation between locking sleeve 240 and actuator 220. Additionally, when locking sleeve 240 is in the unlocked position, relative rotation is permitted between actuator 220 and housing 202.

Stem 260 of ram block assembly 200B has a first or outer end 260A, a second or inner end 260B opposite outer end 260A, and a generally cylindrical outer surface 262 extending between ends 260A, 260B. In this embodiment, outer surface 262 of stem 260 includes a hexagonal portion or surface 264 extending from outer end 260A, a threaded portion or connector 266 extending from hexagonal surface 264 that threadably connects with the threaded connector 226 of actuator 220. Hexagonal surface 264 of stem 260 is configured to interface with a tool (e.g., a wrench) such that torque may be conveniently applied to stem 260. While in this embodiment stem 260 includes hexagonal surface 264, in other embodiments, stem 260 need not include hexagonal surface 264 and may instead, for example, include other mechanisms for permitting the convenient application of torque thereto. The outer surface 262 of stem 260 is sealingly engaged by the seal assemblies 228 of actuator 220, restricting fluid communication across the annular interface formed between stem 260 and actuator 220. In this embodiment, the outer surface 262 of stem 260 also includes a releasable connector 270 positioned at the inner end 260B thereof for releasably coupling stem 260 with ram block 280.

Ram block 280 of lower ram assembly 200B has a first or outer end defined by an outer endface 282, a second or inner end opposite the outer end that is defined by an inner endface 284, and a curved outer surface 286 extending between endfaces 282, 284. A releasable connector 288 is formed in the outer endface 282 for releasably connecting ram block 280 with stem 260. Additionally, pair of circumferentially spaced pin 290 extend between the outer endface 282 of ram block 280 and the inner end 220B of actuator 220 to rotationally lock ram block 280 with actuator 220.

In this embodiment, ram block 280 includes a continuous seal 292 that comprises an inner seal face 292A positioned at the inner endface 284 of ram block 280, a pair of elongate seal faces 292B extending between the outer and inner endfaces 282, 284 of ram block 280, and a circumferential outer seal face 292C positioned at outer endface 282 that extends about the entire circumference of the outer surface 286 of ram block 280. Inner seal face 292A of seal 292 is positioned substantially equidistant between upper and lower ends of ram block 280 and is configured to sealingly engage the outer surface of extension rod 25 extending through the central passage 108 of the housing 102 of ram BOP 100. Elongate seal faces 292B and outer seal face 292C each seal against the inner surface of the lower ram passage 114 in which ram block 280 is disposed to restrict fluid across the annular interface formed between the inner surface of lower ram passage 114 and the outer surface 286 of ram block 280. Additionally, ram block 280 comprises a pressure port 294 that extends between endfaces 282, 284 of ram block 280 and is offset from the inner seal face 292A of seal 292. As will be described further herein, pressure port 294 may be used to communicate fluid pressure between a portion of the inner endface 284 and at least a portion of the outer endface 282 of ram block 280.

Still referring to FIGS. 2-7, ram BOP 100 may be periodically pressure tested to ensure the proper functioning of lower ram assemblies 200B and upper ram assemblies 200A. Particularly, in an embodiment, a tubular member (e.g., extension rod 25) is extended through central passage 108 of housing 102 and each ram assembly 200A, 200B is actuated from a first or open position into a second or closed position such that the inner seal face 292A of each ram assembly 200A, 200B sealingly engages the outer surface of the tubular member. Particularly, in this embodiment, each ram assembly 200A, 200B may be actuated into the closed position by applying a torque to hexagonal surface 264 of each ram assembly 200A, 200B to extend the ram block 280 of each assembly 200A, 200B into a fully extended position engaging the outer surface of the tubular member.

Figure 6:
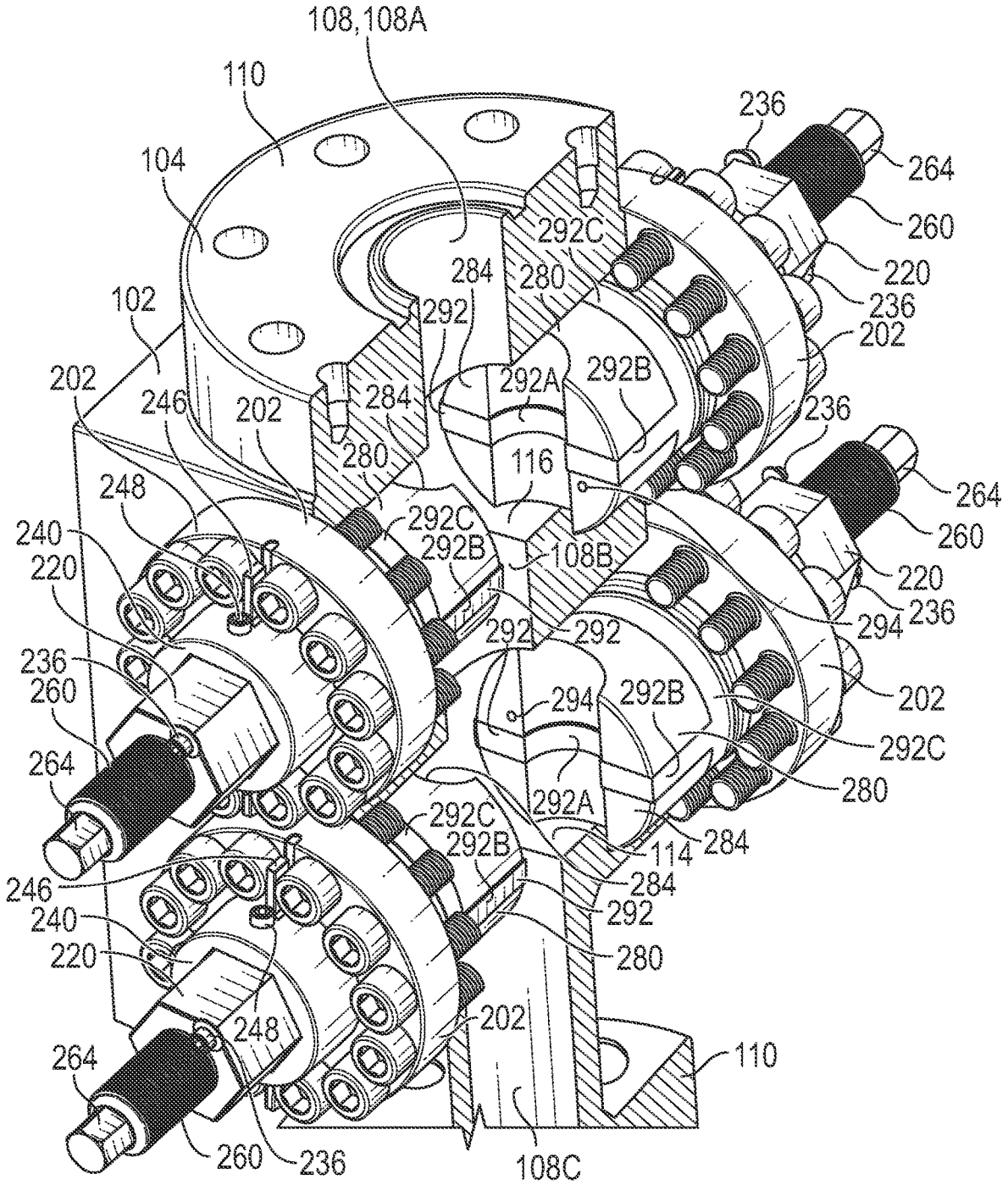
FIG. 6 is a perspective, partial cross-sectional view of the ram BOP of FIG. 2 in a first position.
Figure 7:
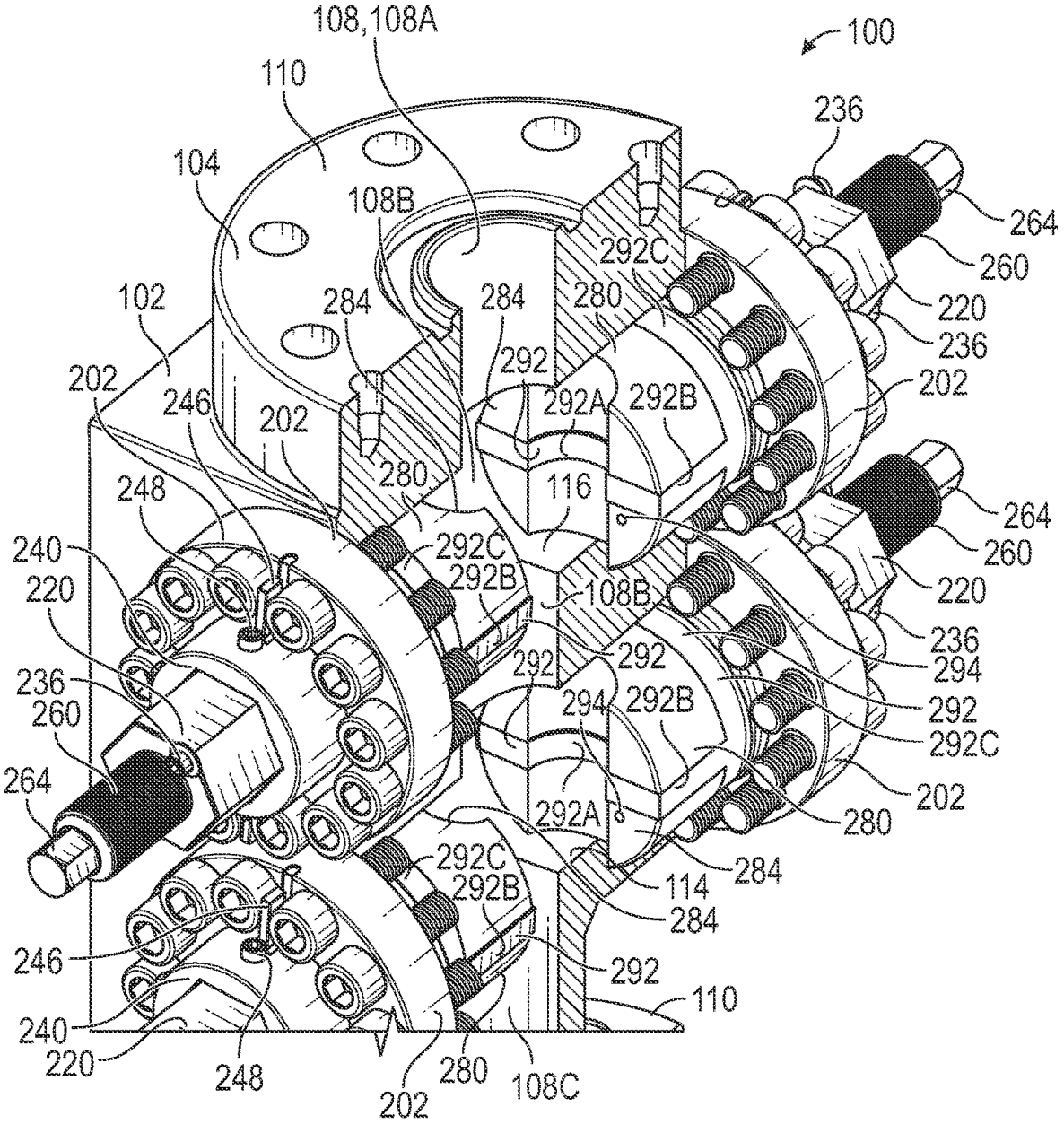
FIG. 7 is a perspective, partial cross-sectional view of the ram BOP of FIG. 2 in a second position.

As shown particularly in FIGS. 6, 7, with ram assemblies 200B, 200A each disposed in the closed position, central passage 108 of housing 102 is divided into an upper passage 108A extending between upper end 104 and the inner seal faces 292A of upper ram assemblies 200A, a central chamber 108B extending between the inner seal faces 292A of upper ram assemblies 200A and the inner seal faces 292A of lower ram assemblies 200B, and a lower passage 108C extending between the inner seal faces 292A of lower ram assemblies 200B and the lower end 106 of housing 102. In this configuration, upper passage 108A is in fluid communication with the upper end 23 of production tubing 20 while lower passage 108C is in fluid communication with the lower end 23 of production tubing 20. Additionally, a first or upper test port 118A is in fluid communication with upper passage 108A, a second or intermediate test port 118B is in fluid communication with central chamber 108B, and a third or lower test port 118C is in fluid communication with lower passage 108C.

In this embodiment, prior to being actuated into the closed position, the ram block 280 of each lower ram assembly 200B is rotatably positioned such that pressure port 294 is on an upper end of ram block 280 and in fluid communication with central chamber 108B of housing 102. This upper position of pressure port 294 comprises a test position (shown in FIG. 6) of lower ram assemblies 200B. Additionally, valves (not shown) may be attached to test ports 118A, 118C, each valve being disposed in a closed position. In this configuration, hydraulic pressure may be applied to intermediate test port 118B from an external pressure source to thereby pressurize central chamber 108B of housing 102 and ascertain the sealing integrity of ram assemblies 200A, 200B.

In this embodiment, with lower ram assemblies 200B disposed in the test position, fluid pressure in central chamber 108B is communicated to the pressure port 294 of the ram block 280 of both ram assemblies 200A, 200B. The pressure port 294 of each ram block 280 communicates fluid pressure from central chamber 108B to the outer endface 282 of the ram block 280, the fluid pressure from central chamber 108B acting against the entire circumference of the outer endface 282. In other words, the pressure port 294 of each ram block 280 equalizes fluid pressure across the entire outer endface 282 of the ram block 280. Given that the inner seal face 292A of each ram block 280 prevents fluid pressure in central chamber 108B from acting against the entire circumference of the inner endface 284 of the ram block 280 (inner seal face 292A extending halfway between upper and lower end of the ram block 280), the pressure port 294 of each ram block 280 provides an inwardly directed (e.g., directed towards central axis 105) pressure force or differential between the endfaces 282, 284 of the ram block 280. The pressure differential provided by the pressure port 294 of each ram block 280 utilizes fluid pressure in central chamber 108B to assist or augment the sealing integrity between the inner seal face 292A of the ram block 280 and the outer surface of the tubular member extending through housing 102, thereby permitting ram assemblies 200A, 200B to sealingly close at higher fluid pressures within central passage 108 of housing 102.

In this embodiment, pressure may be increased in central chamber 108B of housing 102 until a desired test pressure in central chamber 108B has been achieved, at which point a valve (not shown) coupled between intermediate test port 118B and the pressure source may be closed to isolate central chamber 108B from the pressure source. With central chamber 108B closed in by the valve coupled to intermediate test port 118B, pressure within central chamber 108B may be monitored (e.g., via a pressure sensor attached to intermediate test port 118B) over a predetermined period of time or test period. An indication of sealing integrity between ram assemblies 200A, 200B and the outer surface of the tubular member may be indicated by a stable pressure reading of central chamber 108B over the course of the test period.

However, a decline in pressure in central chamber 108B during the test period may indicate that a leak has formed between the tubular member and at least one of the ram assemblies 200A and/or 200B. In response to a decline in pressure in central chamber 108B, the valve coupled to upper test port 108A of housing 102 may be slowly opened to determine if fluid is being communicated between central chamber 108B and upper passage 108A, indicating a leak in one of the upper ram assemblies 200A. If no fluid communication between central chamber 108B and upper passage 108A is noted following the opening of the valve coupled to upper test port 118A, then the valve coupled to lower test port 118C may be opened to confirm that a leak has formed between the tubular member and at least one of the lower ram assemblies 200B. In response to a positive indication that one of the ram assemblies 200A and/or 200B are leaking, the suspected malfunctioning ram assemblies 200A and/or 200B may be removed and replaced from the ram BOP 100.

Following the pressure test of ram BOP 100, the ram block 280 of each lower ram assembly 200B may be actuated from the test position to an operating position that is angularly or circumferentially spaced from the test position. Particularly, in this embodiment, each ram assembly 200A, 200B may be actuated into the open position by applying a torque to hexagonal surface 264 of each ram assembly 200A, 200B to retract displace the ram block 280 of each assembly 200A, 200B into a fully retracted position (shown in FIG. 5). Once in the open position, the locking pins 248 of each lower ram assembly 200B may be removed and the locking sleeve 240 of each lower ram assembly 200B may be retracted to the unlocked position adjacent retainer 236. With the locking sleeve 240 of each lower ram assembly 200B disposed in the unlocked position, a tool may be used to engage the hexagonal surface 232 of the actuator 220 of each lower ram assembly 200B to apply a torque thereto and rotate the actuator 220.

As described above, actuator 220 is rotationally locked with stem 260 and ram block 280, and thus, rotation of the actuator 220 of each lower ram assembly 200B causes the stem 260 and ram block 280 of the lower ram assembly 200B to rotate in concert therewith. In this embodiment, ram block 280 of each lower ram assembly 200B is rotated (via rotation of actuator 220) approximately 180 degrees from the test position to place the ram block 280 in the operating position (shown in FIG. 7); however, in other embodiments, the degree of rotation of ram 280 between the test and operating positions may vary. With the ram block 280 of each lower ram assembly 200B disposed in the operating position, the locking sleeve 240 of each lower ram assembly 200B may be actuated or slid into the locked position and locking pins 248 may be reinserted into the actuator 220 to secure locking sleeve 240 in the locked position, thereby locking the ram block 280 of each lower ram assembly 200B in the operating position.

In the operating position, the ram block 280 of each lower ram assembly 200B is positioned such that the pressure port 294 is in fluid communication with the lower passage 108C of housing 102. Thus, in the event of an uncontrolled pressurization of wellbore 5 and the lower end 21 of production tubing 20 requiring the closure of ram BOP 100 to isolate wellbore 5 from the surrounding environment, fluid pressure in the lower end 21 of production tubing 20 communicated to lower passage 108C of housing 102 will be communicated to the outer endface 282 of the ram block 280 of each lower ram assembly 200B, thereby increasing the sealing integrity between the inner seal faces 292A of lower ram assemblies 200B and the outer surface of the tubular member (e.g., extension rod 25), as described above. Thus, with the ram blocks 280 of lower ram assemblies 200B each disposed in the operating position, ram BOP 100 is configured to isolate wellbore 5 at higher pressures than ram BOP 100 could otherwise seal against without the pressure-assist functionality provided by the pressure ports 294 of ram blocks 280.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A blowout preventer, comprising:

a housing comprising a central passage and a first aperture; and a first ram assembly slidably disposed in the first aperture, wherein the first ram assembly comprises a ram block having a seal and an actuator configured to rotate the ram block, including the seal, when the ram block is disposed in the first aperture of the housing;

wherein the ram block of the first ram assembly comprises an open position and a closed position that is linearly spaced from the open position and extended through the first aperture towards the central passage of the housing relative to the open position.

2. The blowout preventer of claim 1, wherein the ram block of the first ram assembly comprises a port extending between a first endface and a second endface of the ram block.

3. The blowout preventer of claim 1, further comprising a plurality of circumferentially spaced pins extending between the actuator and the ram block of the first ram assembly.

4. The blowout preventer of claim 1, wherein the ram block of the first ram assembly includes a port extending between a first endface and a second endface of the ram block.

5. The blowout preventer of claim 1, wherein the first ram assembly further comprises a locking sleeve disposed about the actuator, wherein the locking sleeve comprises a locked position restricting relative rotation between the ram block and the housing and an unlocked position permitting relative rotation between the ram block and the housing.

6. The blowout preventer of claim 5, wherein the first ram assembly further comprises a locking pin coupled to the locking sleeve and the actuator, wherein the locking pin is configured to lock the locking sleeve in the locked position.

7. The blowout preventer of claim 1, further comprising a second ram assembly slidably disposed in a second aperture formed in the housing that is axially spaced from the first aperture, wherein the second ram assembly comprises a ram block and an actuator configured to rotate the ram block of the second ram assembly when the ram block is disposed in the second aperture of the housing.

8. The blowout preventer of claim 7, wherein the ram block of the second ram assembly includes a port extending between a first endface and a second endface of the ram block.

9. A ram assembly for a blowout preventer, comprising:

a housing configured to couple with a housing of the blowout preventer, wherein the housing of the blowout preventer comprises a central passage and an aperture;

a ram block having a seal, wherein the ram block is coupled to a stem is configured to be slidably disposed in the aperture, and wherein the ram block comprises an open position and a closed position that is extended through the aperture towards the central passage of the housing of the blowout preventer relative to the open position; and an actuator disposed about the stem, and wherein the actuator is configured to rotate the ram block, including the seal, in response to the application of a torque to an outer surface of the actuator.

10. The ram assembly of claim 9, wherein the actuator comprises an outer surface comprising a plurality of circumferentially spaced planar surfaces.

11. The ram assembly of claim 9, wherein the actuator comprises a threaded inner surface configured to matingly engage a threaded outer surface of the stem.

12. The ram assembly of claim 9, further comprising a plurality of circumferentially spaced pins extending between the actuator and the ram block that rotationally lock the actuator with the ram block.

13. The ram assembly of claim 9, further comprising a locking sleeve disposed about the actuator, wherein the locking sleeve comprises a locked position restricting relative rotation between the ram block and the housing of the ram assembly and an unlocked position permitting relative rotation between the ram block and the housing of the ram assembly.

14. The ram assembly of claim 13, further comprising a locking pin coupled to the locking sleeve and the actuator, wherein the locking pin is configured to lock the locking sleeve in the locked position.

15. The ram assembly of claim 13, further comprising a locking tab extending from an outer surface of the locking sleeve, wherein the locking tab is configured to restrict relative rotation between the actuator and the housing when the locking sleeve is in the locked position.

16. The ram assembly of claim 13, further comprising a retainer coupled to an end of the actuator, wherein the locking sleeve is disposed adjacent the retainer when the locking sleeve is in the unlocked position.

17. A method for operating a blowout preventer, comprising:

(a) disposing a first ram assembly in a first aperture formed in a housing of the blowout preventer;

(b) rotating a ram block, including a seal of the ram block, of the first ram assembly between a first angular position and a second angular position with the first ram assembly disposed in the first aperture of the housing; and (c) actuating the ram block between an open position and a closed position that is linearly spaced from the closed position and that is extended through the first aperture towards the central passage of the housing relative to the open position.

18. The method of claim 17, wherein (b) comprises applying a torque to an actuator that is rotatably locked to the ram block.

19. The method of claim 18, further comprising:

(d) displacing a locking sleeve from a locked position to an unlocked position to permit relative rotation between the actuator and a housing of the first ram assembly.

20. The method of claim 19, further comprising:

(e) removing a locking pin from the locking sleeve to permit the locking sleeve to enter the unlocked position.

* * * * *